US006695621B1

(12) United States Patent
Wang

(10) Patent No.: US 6,695,621 B1
(45) Date of Patent: Feb. 24, 2004

(54) TOWING CONNECTOR

(76) Inventor: Jen-Ching Wang, No. 27, Alley 4, Lane 446, Fu Hsin Rd., Shu Lin Chen, Taipei County (TW)

( * ) Notice: Subject to any disclaimer, the term of this patent is extended or adjusted under 35 U.S.C. 154(b) by 0 days.

(21) Appl. No.: 10/396,782

(22) Filed: Mar. 26, 2003

(51) Int. Cl.[7] ..... H01R 33/00

(52) U.S. Cl. ..... 439/35; 439/445; 439/447; 439/901

(58) Field of Search ..... 439/34, 35, 638, 439/639, 650, 651, 652, 654, 656, 540.1, 655, 445, 447, 448, 455, 449, 471, 901

(56) References Cited

U.S. PATENT DOCUMENTS 3,818,420 A * 6/1974 Barr ..... 439/261
5,300,734 A * 4/1994 Suzuki ..... 174/152 G
5,380,224 A * 1/1995 DiCicco ..... 439/610
5,397,243 A * 3/1995 MacMurdo, Sr. ..... 439/136
5,800,188 A * 9/1998 Barber et al. ..... 439/142
6,338,644 B1 * 1/2002 Fritzinger et al. ..... 439/445
6,447,302 B1 * 9/2002 Davis ..... 439/34

* cited by examiner

*Primary Examiner*—Tho D. Ta
(74) *Attorney, Agent, or Firm*—Troxell Law Office PLLC

(57) ABSTRACT

A towing connector is constructed to include a housing defining a receptacle, which holds a U-shaped conducting plate and 6 metal contact plates around the U-shaped conducting plate, a 4-pole female connector mounted in an insertion hole in the housing, first conducting wires respectively connected to the metal contact plates, second conducting wires connecting the 4-pole female connector to four of the first conducting wires, a 4-pole male connector connected to the other ends of the four first conducting wires being connected to the second conducting wires, a front cover and a sealing cap pivoted to the housing and forced by a torsional spring to close the receptacle and the 4-pole female connector, a rear cap and a flexible bellows tube adapted to protect the conducting wires, and a bracket detachably fastened to the housing by screws for mounting.

3 Claims, 13 Drawing Sheets

TOWING CONNECTOR

BACKGROUND AND SUMMARY OF THE INVENTION

The present invention relates towing connectors for use in towing vehicles and, more particularly, to such a towing connector, which is easy and inexpensive to manufacture and, which is detachable for easy maintenance.

Various towing connectors for use in towing vehicles are known. Exemplars of towing connectors are seen in U.S. Pat. Nos. 5,951,332 and 6,027,377 (issued to the present inventor), U.S. Pat. No. 6,447,302,B1, and U.S. Des. 409, 125. FIGS. 1 and 2 show a similar prior art design. According to this design, the towing connector 8 is comprised of a top cover 81, a sealing cap 82, a rubber cushion 83, a casing 84, a 4-pole female connector 85, a bracket 86, a conducting wire holder block 87, and a 4-pole male connector 88. This conventional design has drawbacks as follows:

1. When the conducting wire holder block 87 set in the tubular shaft 841 of the casing 84 after the connection of the conducting wires 91 to the conducting wire holder block 87, a plastic member 80 must be molded in the casing 84 to fixedly secure the conducting wire holder block 87 and the tubular shaft 841 together (see FIG. 2). After molding, the assembly must be invertedly set in position for drying. It takes about 4~24 hours to dry the plastic member 80. Therefore, the fabrication of this design of towing connector consumes much time and labor.
2. Because the conducting wires 91 are not detachable from the conducting wire holder block 87 after the molding of the plastic member 80, the user cannot change the number of the conducting wires 91 to fit different male and female connectors. When damaged, the assembly of the conducting wires 91 and the conducting wire holder block 87 become useless and must be thrown away.
3. After installation of the towing connector 8 in a towing vehicle, the conducting wires 91 are exposed to the outside without protection, therefore the conducting wires 91 tend to be stretched or damaged by an external body.

The invention has been accomplished to provide a towing connector, which eliminates the aforesaid drawbacks. According to the present invention, the towing connector comprises housing defining a receptacle, which holds a U-shaped conducting plate and 6 metal contact plates around the U-shaped conducting plate, a 4-pole female connector mounted in an insertion hole in the housing, first conducting wires respectively connected to the metal contact plates, second conducting wires connecting the 4-pole female connector to four of the first conducting wires, a 4-pole male connector connected to the other ends of the four first conducting wires being connected to the second conducting wires, a front cover and a sealing cap pivoted to the housing and forced by a torsional spring to close the receptacle and the 4-pole female connector, a rear cap and a flexible bellows tube adapted to protect the conducting wires, and a bracket detachably fastened to the housing by screws for mounting. By means of loosening the screws, the rear cap can easily be opened so that the maintenance engineer can check or replace the conducting wires. The invention eliminates the employment of the conventional plastic member molding procedure. The metal contact plates are simultaneously and quickly installed in the housing by stamping. Further, the housing has projecting members at the rear side. The projecting members have a respective partition plate of V-shaped cross section adapted to prohibit accidental contact between the metal contact plates.

DETAILED DESCRIPTION OF THE INVENTION

Figure 1:
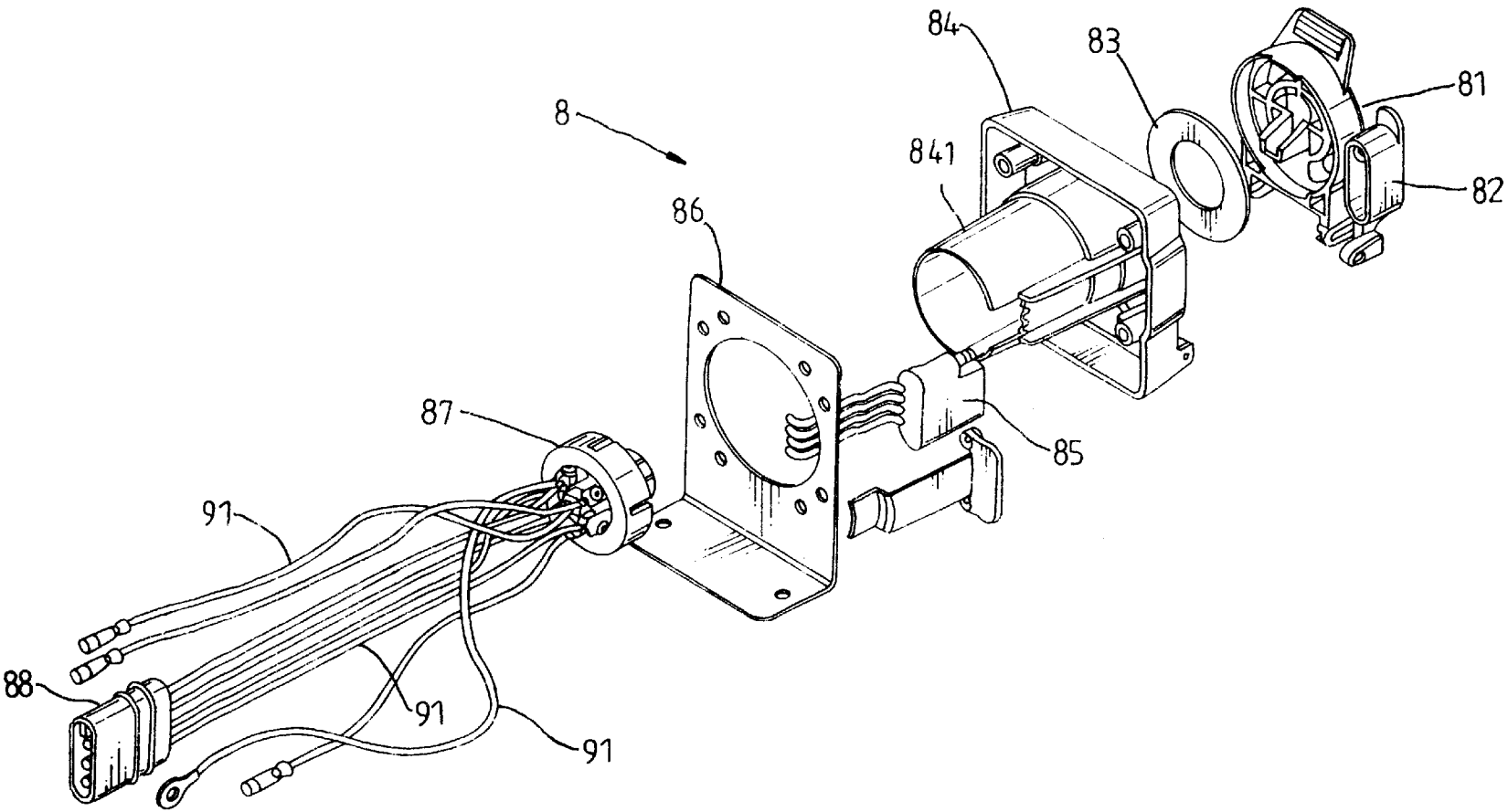
Fig. 1 PRIOR ART
FIG. 1 is an exploded view of a towing connector according to the prior art.
Figure 2:
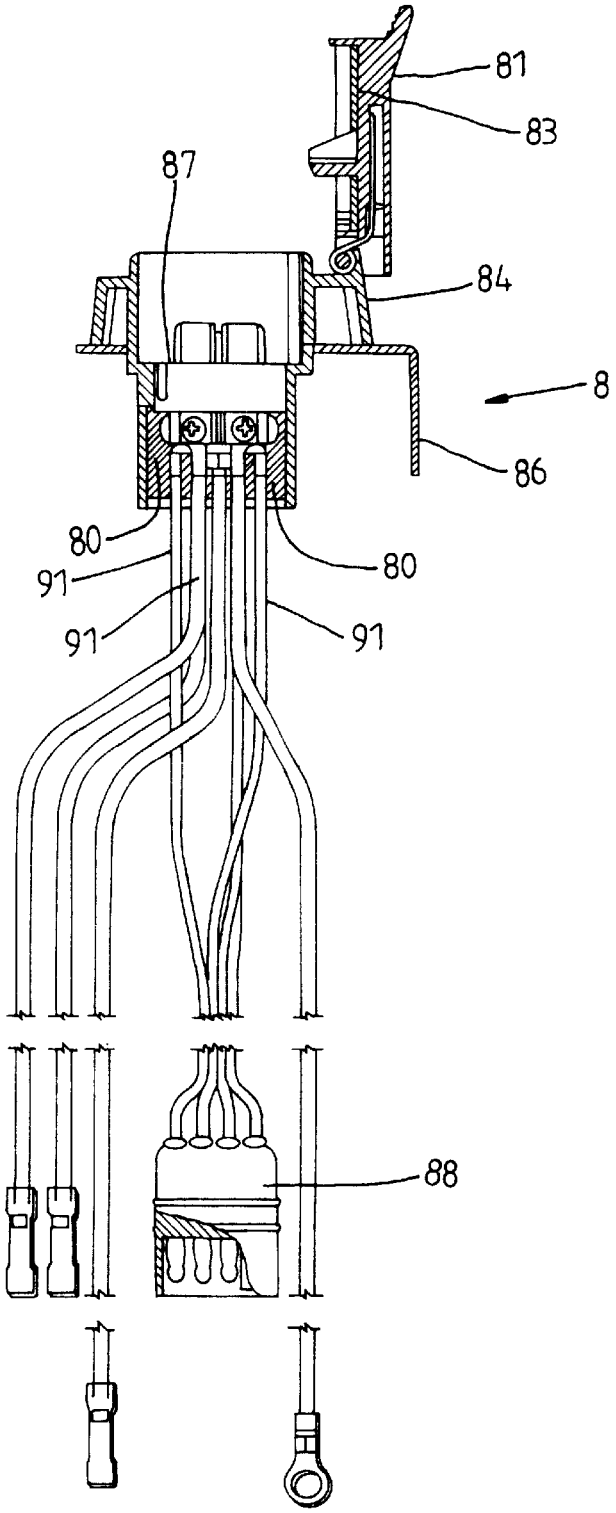
Fig. 2 PRIOR ART
FIG. 2 is a sectional assembly view of the towing connector according to the prior art.
Figure 3:
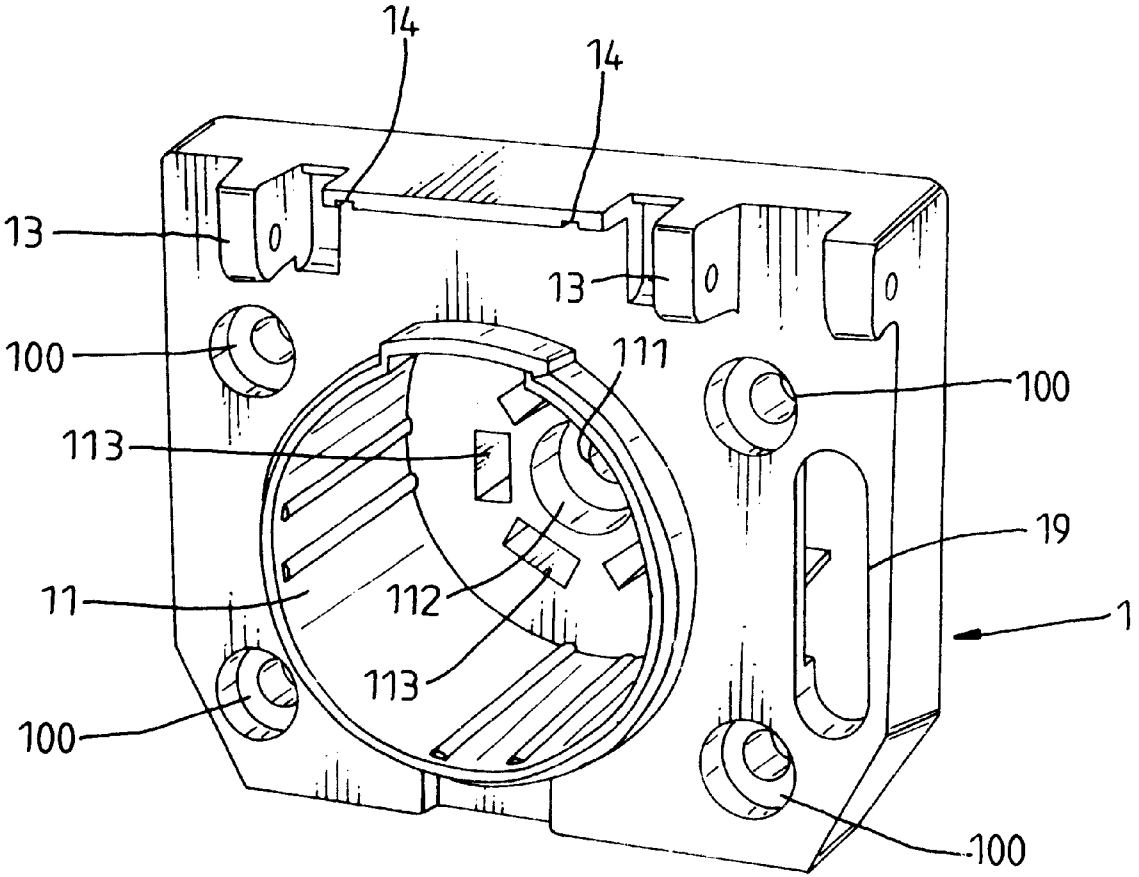
FIG. 3 is an oblique front elevation of a housing for towing connector according to the present invention.

Referring to FIGS. from 3 through 13, a towing connector in accordance with the present invention is shown comprised of a housing 1, 6 metal contact plates 2, a 4-pole female connector 6, a 4-pole male connector 60, a U-shaped conducting plate 20, a rear cap 7, a bracket 10, and a flexible bellows tube 70.

Figure 7:
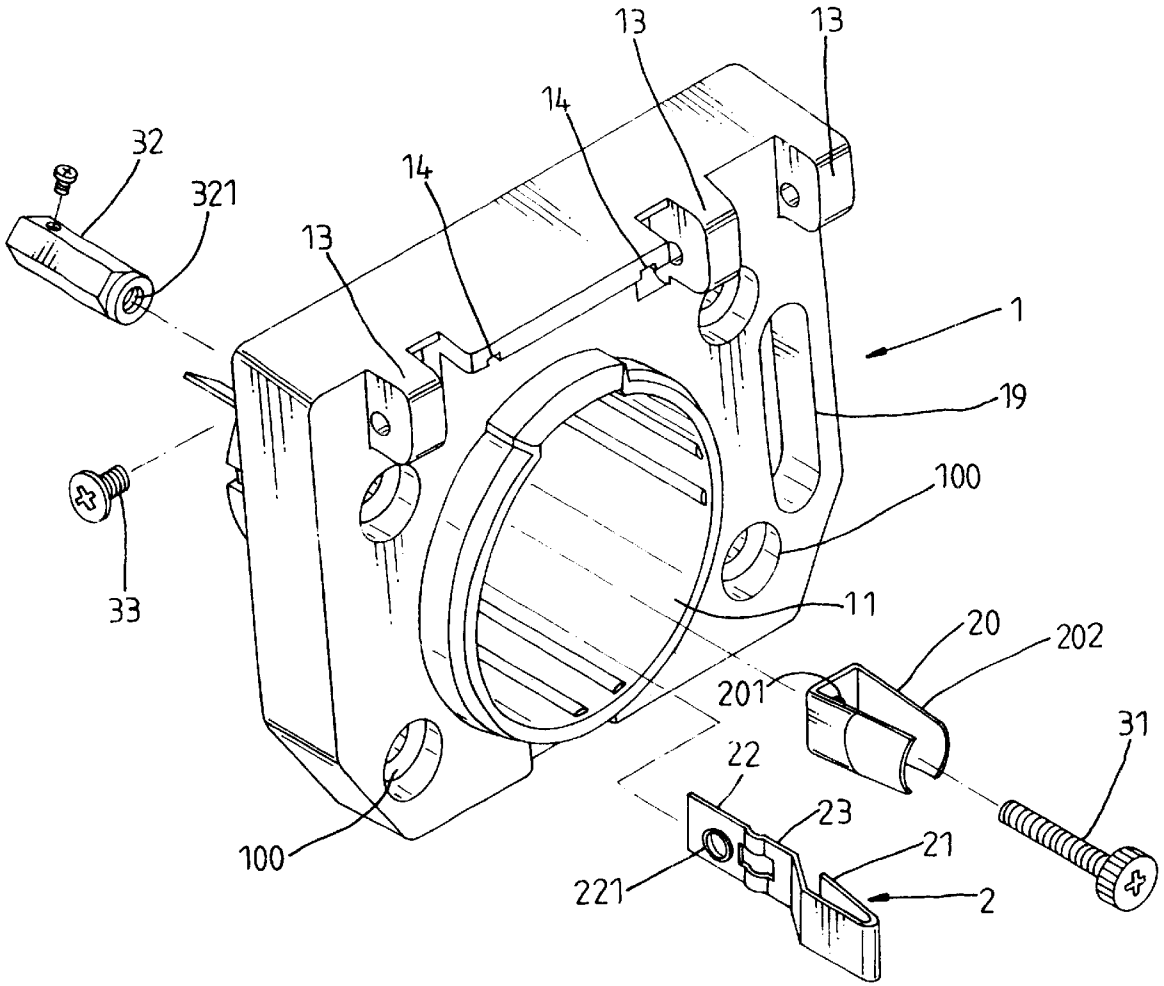
FIG. 7 is an exploded view of FIG. 6.
Figure 8:
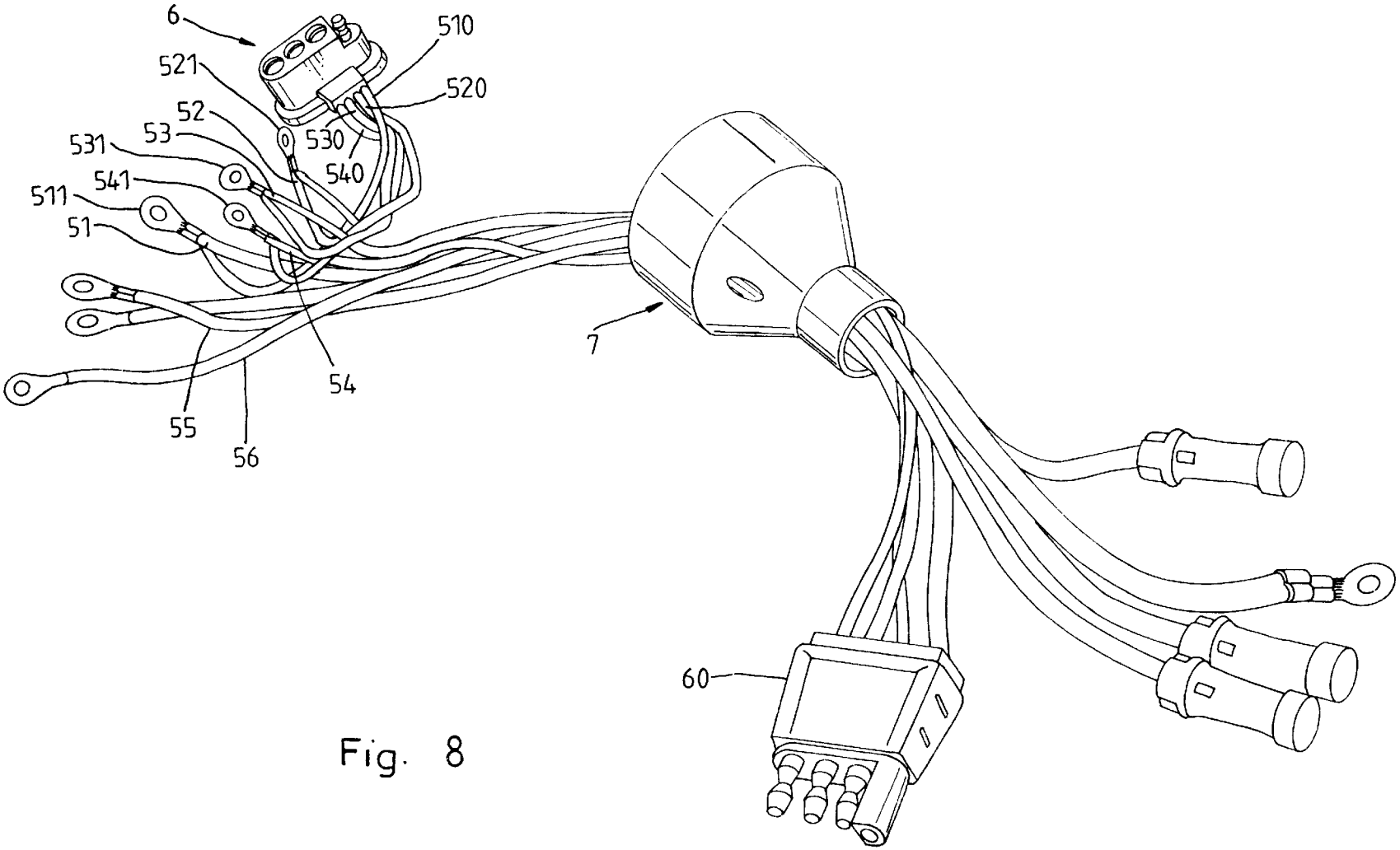
FIG. 8 is a perspective view of a part of the present invention, showing the relationship among the rear cap, the 4-pole male connector, the 4-pole female connector, and the related conducting wires.
Figure 9:
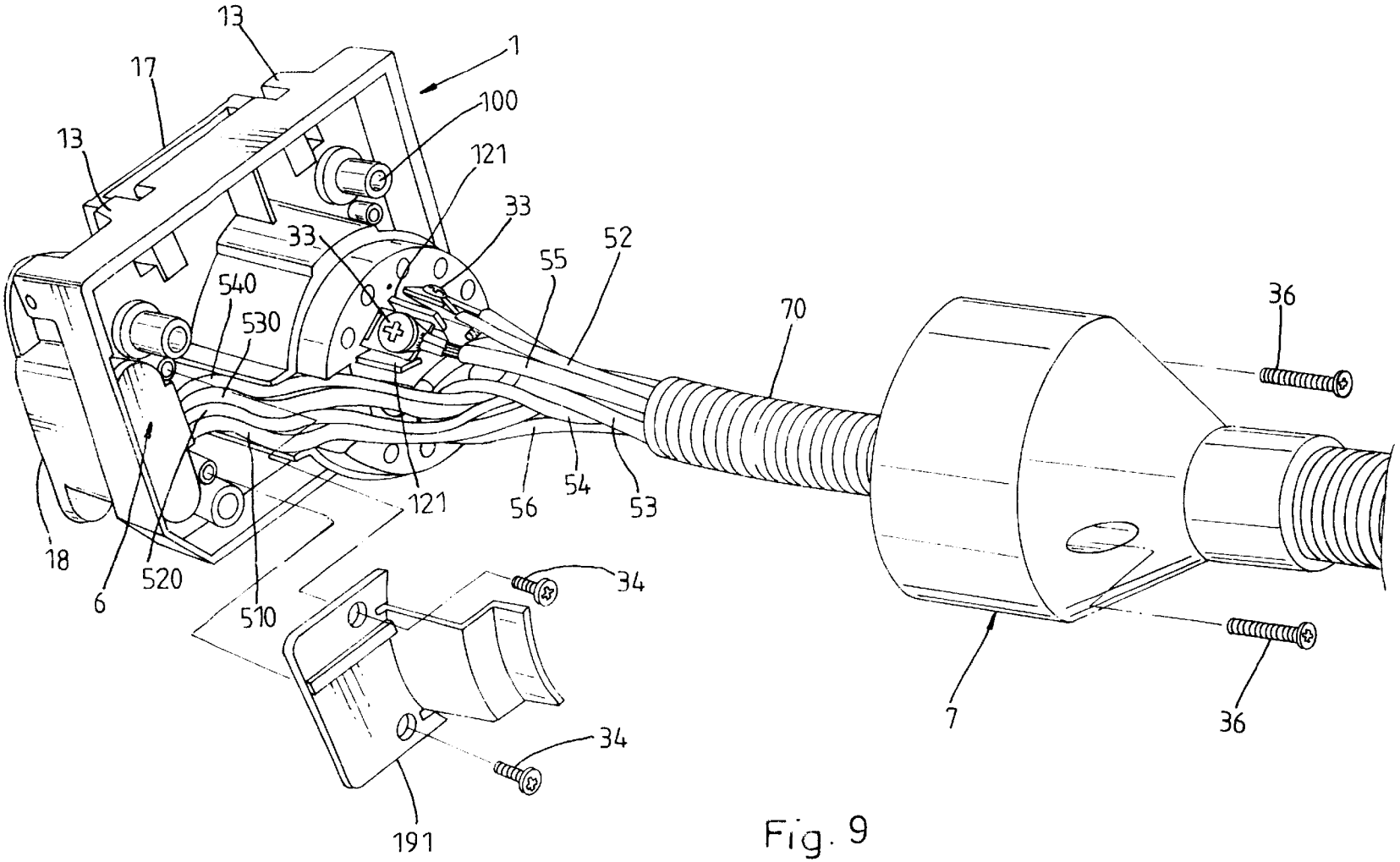
FIG. 9 is a perspective view of a part of the present invention, showing the relationship among the housing, the locating plate, the conducting wires, the bellows tube, and the rear cap.
Figure 10:
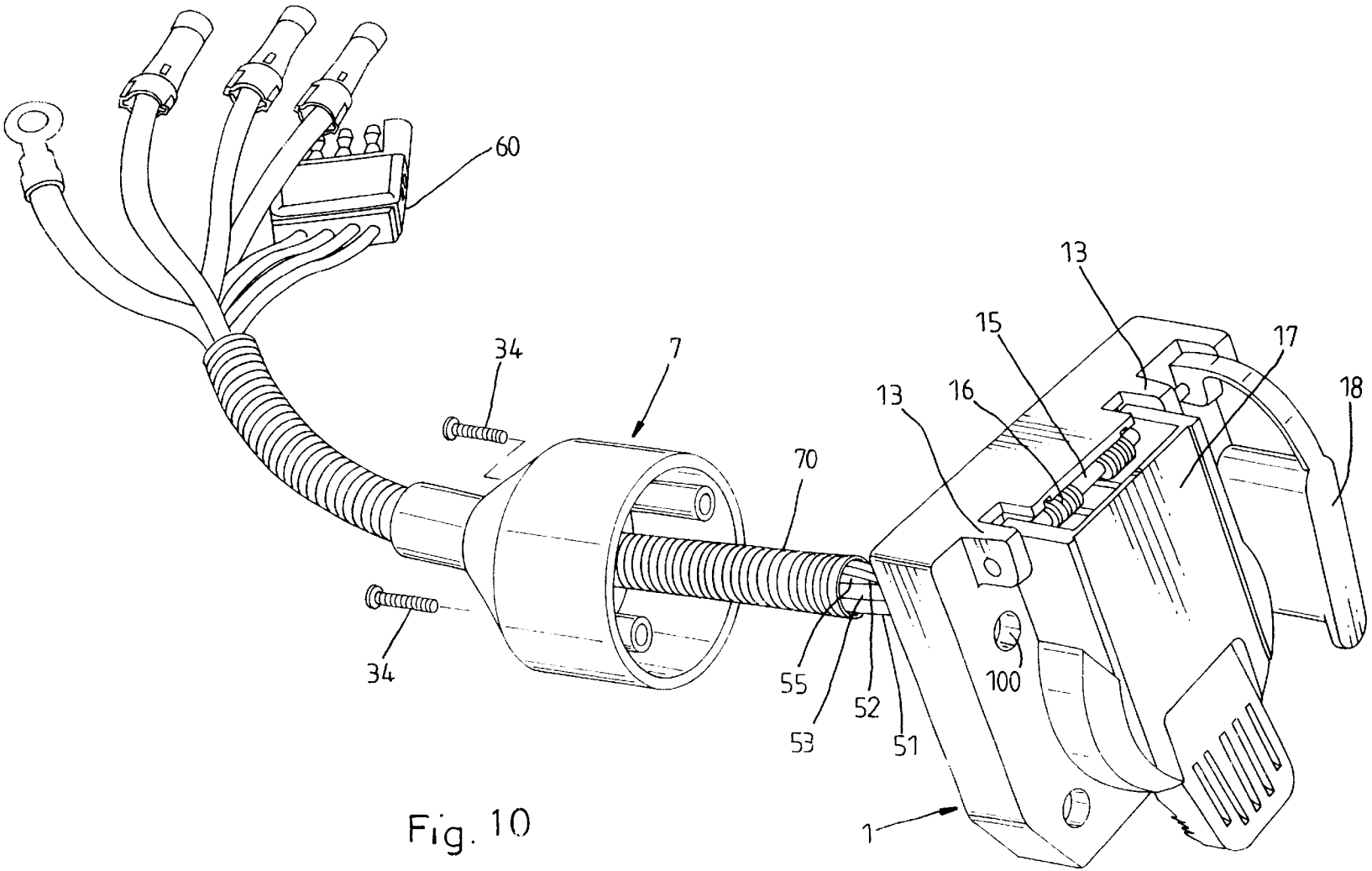
FIG. 10 is an assembly view of the present invention before the connection of the rear cap to the housing, showing the front cover and the sealing cap closed.

The housing 1 is injection-molded from plastics, comprising a receptacle 11, a circular recess 112 formed in the inner side of the bottom wall of the receptacle 11, an axle hole 111 axially extended through the center of the circular recess 112 of the receptacle 11, 6 mounting slots 113 formed in the bottom wall of the receptacle 11 and equiangularly spaced around the circular recess 112 for the positioning of the metal contact plates 2 respectively, 6 projecting members 12 of V-shaped cross-section backwardly extended from the rear sidewall and equiangularly spaced around the axle hole 111, a plurality of lugs 13 projected from the front sidewall above the receptacle 11, two locating notches 14 spaced between the lugs 13, a front cover 17 and a sealing cap 18 pivotally fastened to the lugs 13 by a pivot 15, a torsional spring 16 mounted on the pivot 15 and positioned in the locating notches 14 and adapted to hold the front cover 17 and a sealing cap 18 in the closed status (see FIG. 7), an elongated insertion hole 19 disposed near one side, which receives the 4-pole female connector 6, a locating plate 191 detachably fastened to the rear sidewall by screws 34 to stop the 4-pole female connector 6 in the insertion hole 19 and to hold down the conducting wires 510,520,530,540 of the 4-pole female connector 6 (see FIG. 9), and a plurality of bracket mounting holes 100 axially formed in the front sidewall around the receptacle 11.

Figure 11:
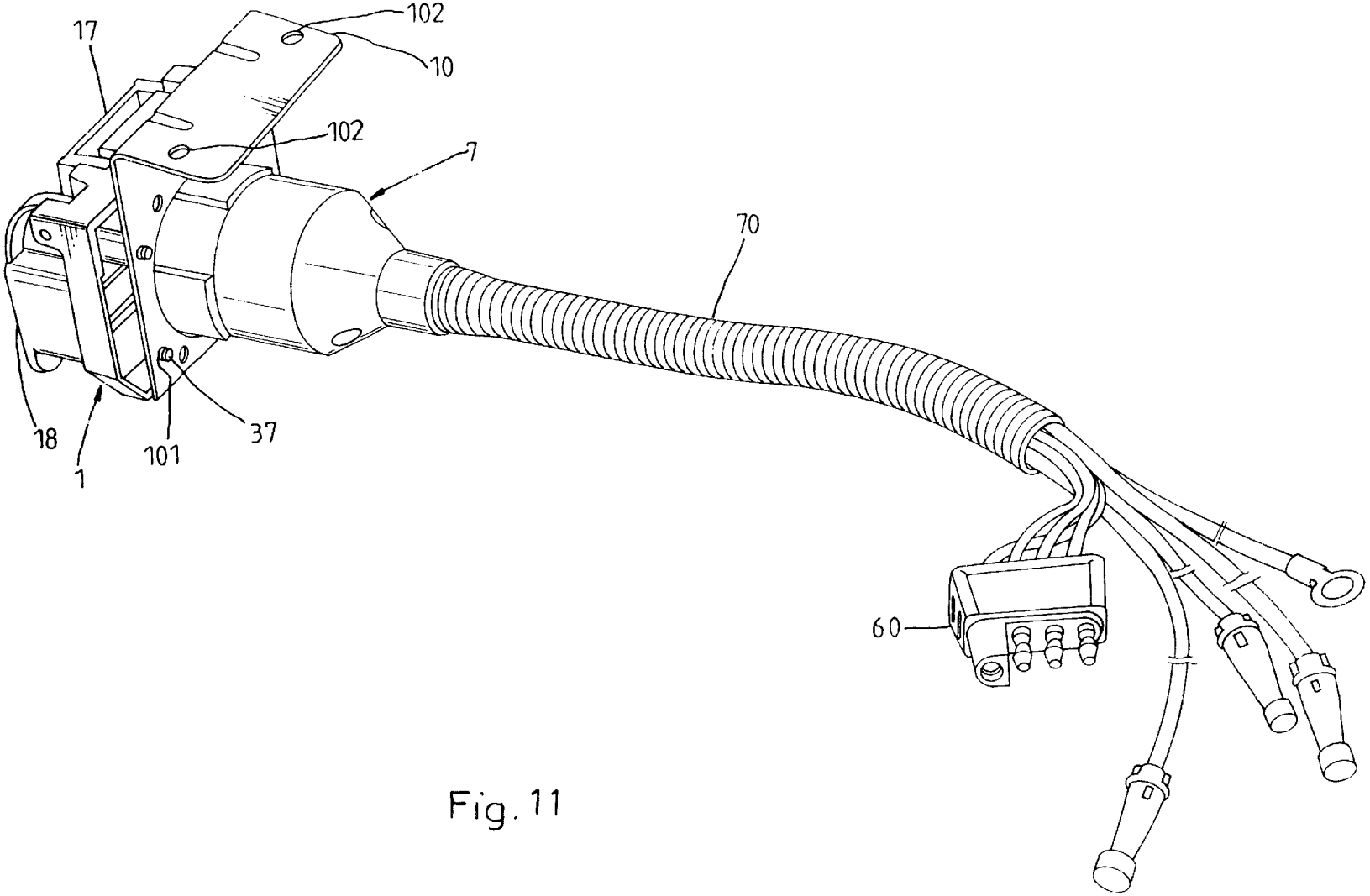
FIG. 11 is a perspective assembly view of the towing connector according to the present invention.
Figure 12:
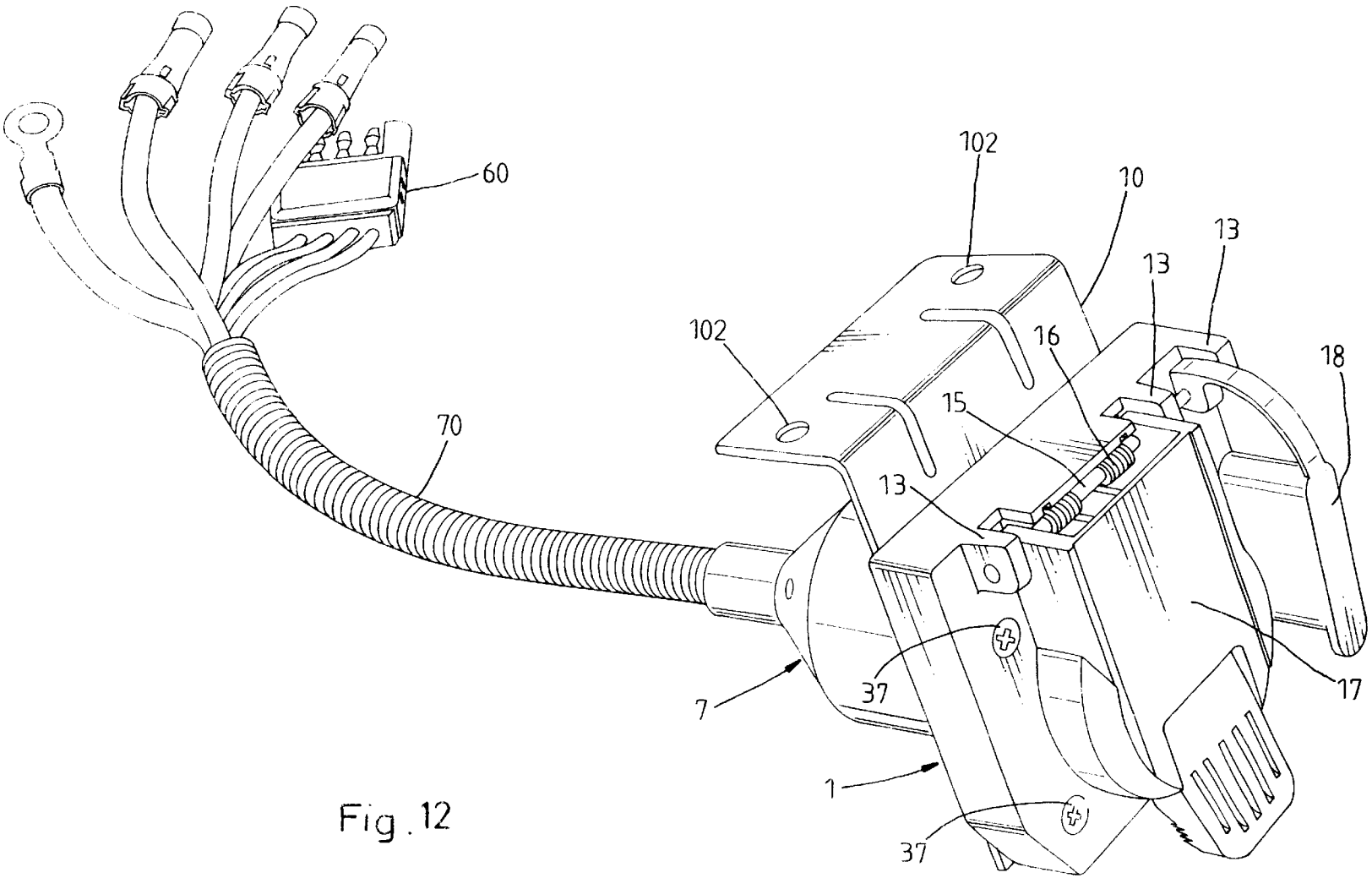
FIG. 12 is another perspective assembly view of the towing connector according to the present invention when viewed from another angle.
Figure 13:
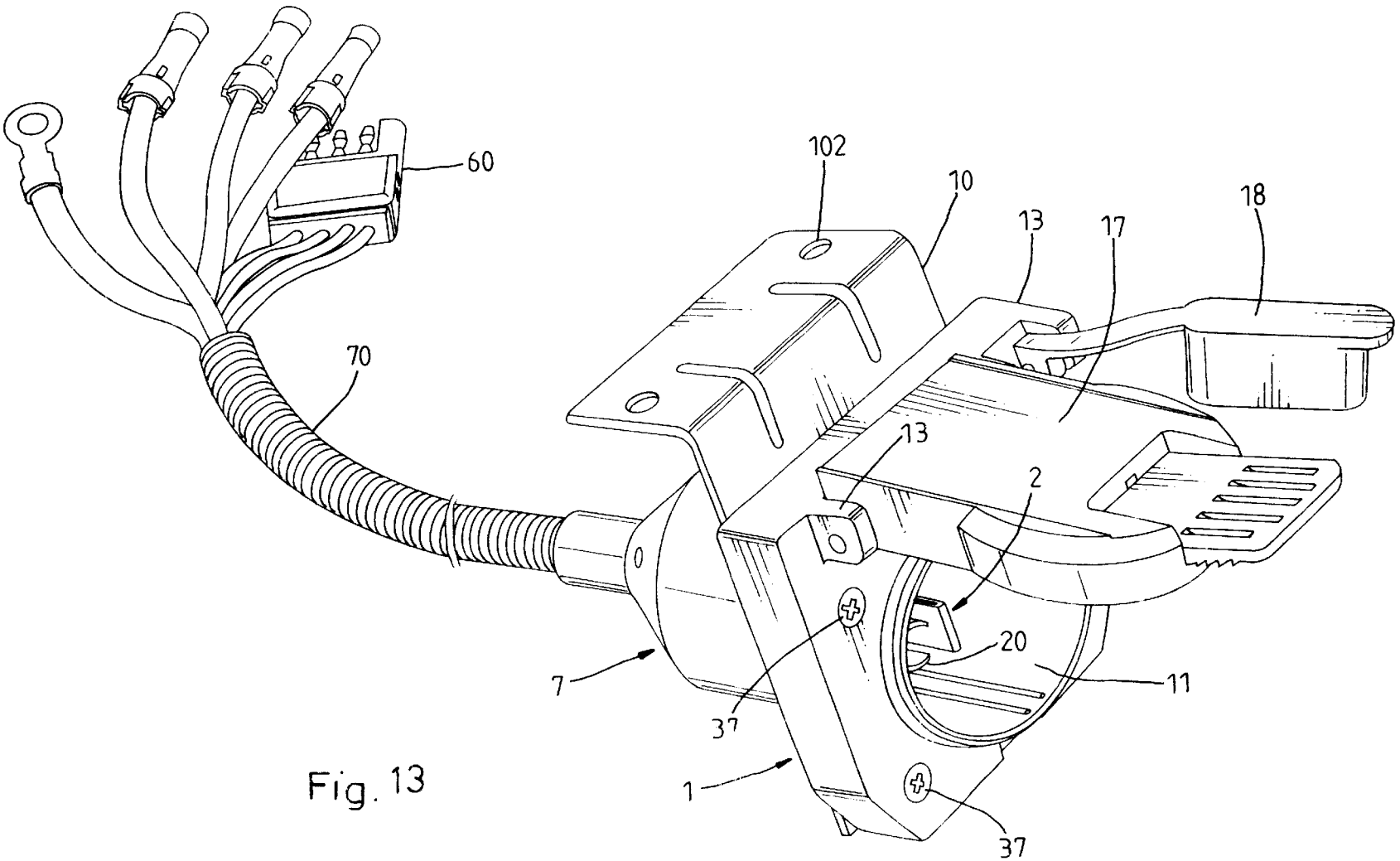
FIG. 13 is a perspective view of the towing connector according to the present invention, showing the front cover and the sealing cap opened.

The bracket 10 has first mounting holes 101 respectively fastened to the bracket mounting holes 100 of the housing 1 by screws 37 (see FIG. 12), and a plurality of second mounting holes 102 (see FIGS. 11 and 12) for fastening to the chassis of a towing vehicle (not shown).

The metal contact plates 2 are respectively mounted in the mounting slots 113, each having a front end terminating in a clamping portion 21, which is suspended inside the receptacle 11, a rear end terminating in a connecting portion 22, which extends out of the corresponding mounting slot 113 and suspended at one side of one corresponding projecting member 12, a curved middle positioning portion 23 connected between the front clamping portion 21 and the rear connecting portion 22 and a screw hole 221 transversely formed in the rear connecting portion 22.

There are provided 6 conducting wires 51,52,53,54,55,56 respectively fastened to the screw hole 221 of each metal contact plate 2 by a respective screw 33.

The 4-pole female connector 6 is mounted in the elongated insertion hole 19 of the housing 1 and sealed by the sealing cap 18, having the four power conducting wires 510,520,530,540 respectively connected to four conducting wires 51,52,53,54 of the 6 conducting wires 51,52,53,54, 55,56 through a respective terminal 511,521,531,541.

The 4-pole male connector 60 is connected to the other ends of the four conducting wires 51,52,53,54 being connected to the 4-pole female connector 6.

The U-shaped conducting plate 20 is positioned in the circular recess 112 inside the receptacle 11 of the housing 1, having a center through hole 201 and two side wings 202. A screw bolt 31 is mounted in the center through hole 201 and the axle hole 111 and threaded into the center screw hole 321 of a nut 32 to fix the U-shaped conducting plate 20 to the circular recess 112 inside the receptacle 11 of the housing 1.

The rear cap 7 is fastened to the rear sidewall of the housing 1 by screws 36, having a center through hole (not shown) through which the conducting wires 51,52,53,54,55, 56 are inserted and then respectively fastened to the screw hole 221 of each metal contact plate 2.

The flexible bellows tube 70 is mounted around the conducting wires 51,52,53,54,55,56 for protection.

Further, the projecting members 12 of the housing 1 each have a partition plate 121. The partition plates 121 of the projecting members 12 prohibit accidental contact between the metal contact plates 2.

Figure 4:
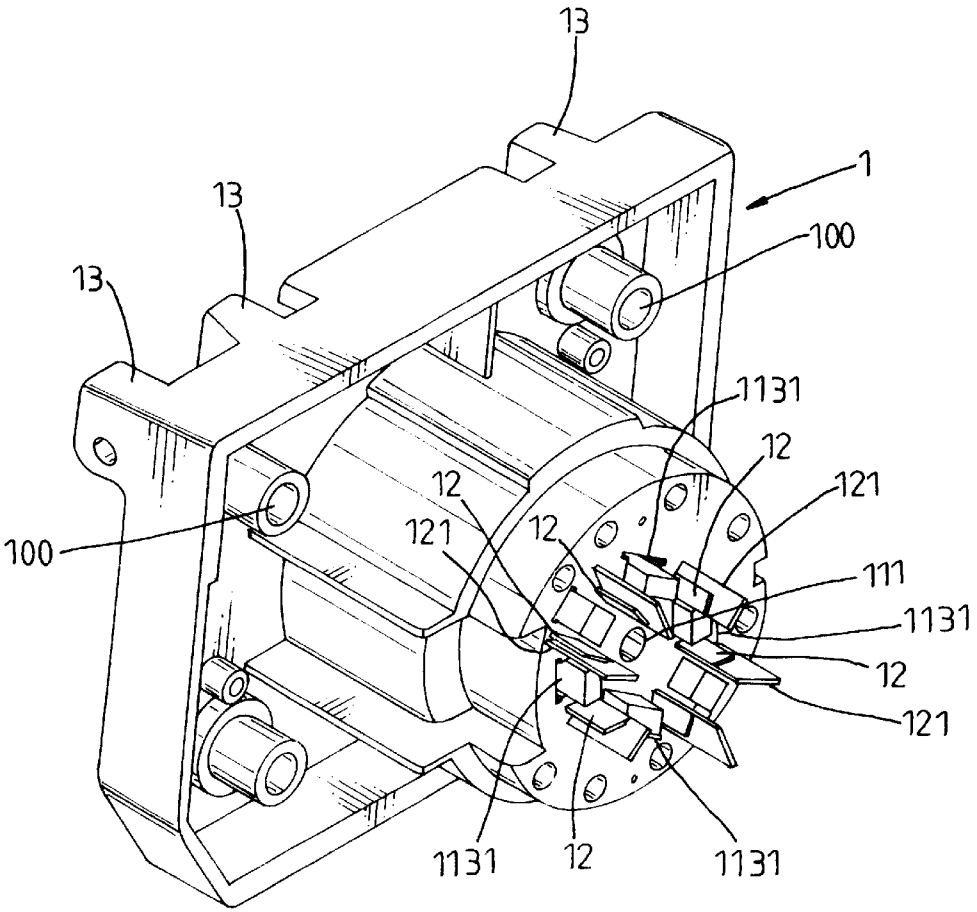
FIG. 4 is an oblique rear elevation of the housing for towing connector according to the present invention.
Figure 5:
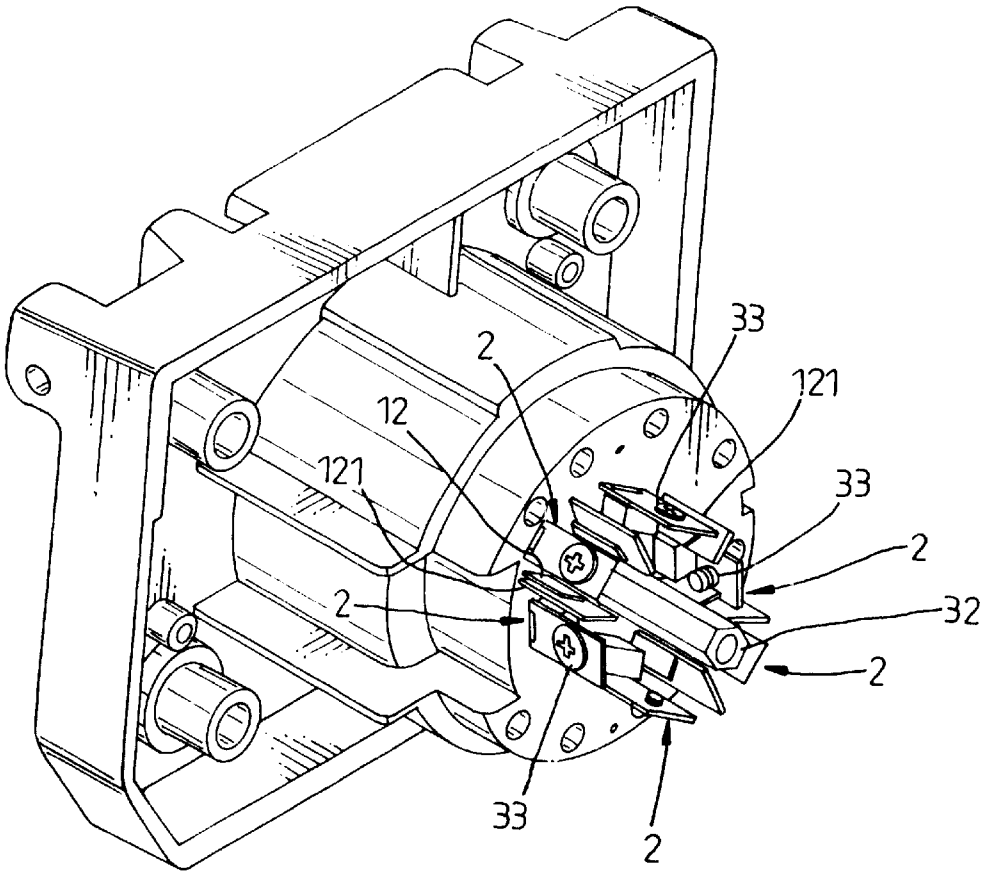
FIG. 5 is similar to FIG. 4 but showing a metal contact plates and a U-shaped conducting plate installed.
Figure 6:
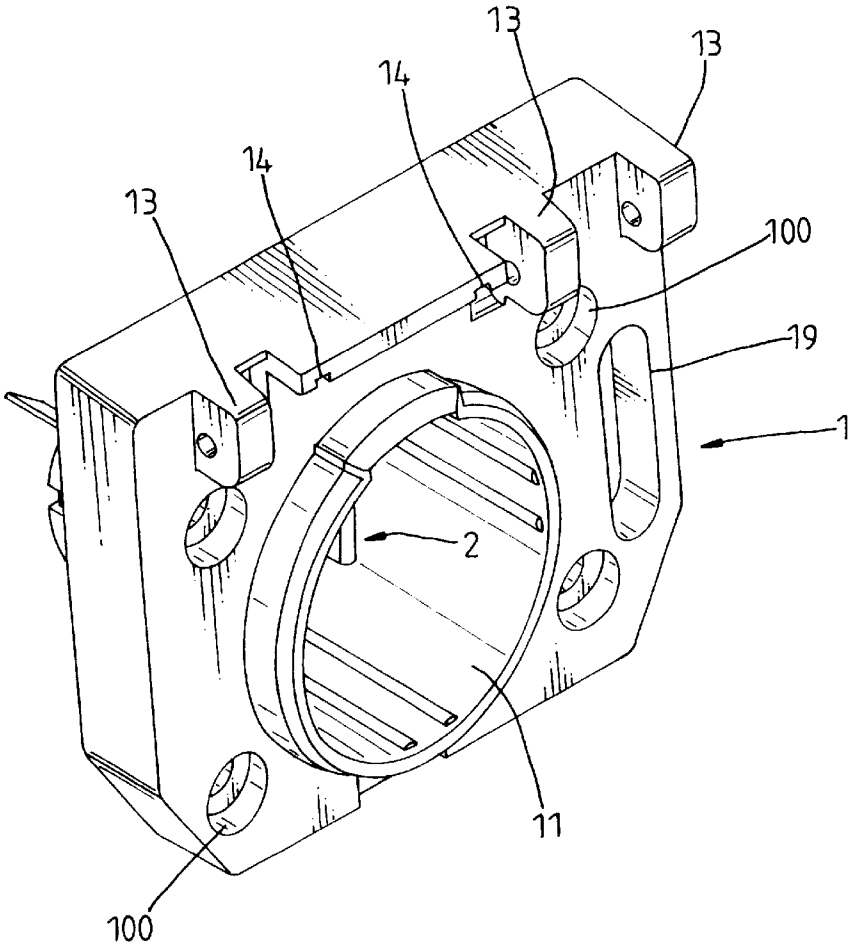
FIG. 6 is another oblique front elevation of the housing for towing connector after installation of the metal contact plates and the U-shaped conducting plate.

Further, the housing 1 has end notches 1131 disposed in the rear sidewall and respectively connected to the rear end of each mounting slot 113 (see FIG. 4). After insertion of the metal contact plates 2 in the mounting slots 113, the rear connecting portions 22 of the metal contact plates 2 are stamped and engaged into the end notches 1131. When installed, the curved middle positioning portions 23 of the metal contact plates 2 are respectively positioned in the mounting slots 113, and the front clamping portions 21 of the metal contact plates 2 are disposed outside the mounting slots 113 and suspended inside the receptacle 11. Because the metal contact plates 2 are simultaneously fastened to the end notches 1131 of the housing 1 by stamping, the installation of the metal contact plates 2 is easy and quick.

As indicated above, the invention has the following advantages:

1. By means of loosening the screws 36, the rear cap 7 can easily be opened so that the maintenance engineer can further remove the locating plate 191 from the housing 1 and check or replace the conducting wires 510,520,530, 540 of the 4-pole female connector 6 as well as the conducting wires 51,52,53,54,55,56.
2. Because the invention eliminates the employment of the conventional plastic member molding procedure and because the metal contact plates 2 can simultaneously and quickly be installed in the housing 1 by stamping, the assembly procedure of the towing connector consumes less time and labor.
3. The partition plates 121 of the projecting members 12 prohibit accidental contact between the metal contact plates 2.

What is claimed is:

1. A towing connector comprising:

an electrically insulating housing, said housing comprising a receptacle, a circular recess formed in an inner surface of a bottom wall of said receptacle, an axle hole axially extended through the center of said circular recess of said receptacle, a plurality of mounting slots formed in a bottom wall of said receptacle and equiangularly spaced around said circular recess, a plurality of lugs projected from a front sidewall thereof above said receptacle, two locating notches spaced between said lugs, an elongated insertion hole disposed near one lateral side thereof, a front cover and a sealing cap pivotally fastened to said lugs by a pivot and adapted to close said receptacle and said elongated mounting hole, a torsional spring mounted on said pivot and positioned in said locating notches and adapted to hold said front cover and said sealing cap in a close position closing said receptacle and said elongated mounting hole respectively, and a plurality of bracket mounting holes axially formed in a front sidewall thereof around said receptacle;

a bracket adapted to support said housing on a towing vehicle, said bracket having a plurality of first mounting holes respectively fastened to the bracket mounting holes of said housing by screws, and a plurality of second mounting holes for fastening to a towing vehicle;

a plurality of metal contact plates respectively mounted in the mounting slots of said housing, said metal contact plates each having a front end terminating in a clamping portion, which is suspended inside said receptacle, a rear end terminating in a connecting portion, which extends out of the corresponding mounting slot of said housing, a curved middle positioning portion connected between said front clamping portion and said rear connecting portion and positioned in the corresponding mounting slot of said housing, and a screw hole transversely formed in said rear connecting portion;

a plurality of conducting wires respectively fastened to the screw holes of said metal contact plates by a respective screw;

a 4-pole female connector mounted in the elongated insertion hole of said housing and sealed by said sealing cap, said 4-pole female connector having four power wires respectively connected to four of said conducting wires;

a 4-pole male connector connected to opposite ends of the four conducting wires being connected to said 4-pole female connector;

a U-shaped conducting plate positioned in said circular recess inside said receptacle of said housing, said U-shaped conducting plate having a center through hole connected to the axle hole of said housing by a screw and a nut and two side wings suspended inside said receptacle;

a locating plate fastened to the rear sidewall of said housing by screws and adapted to stop said 4-pole female connector in said insertion hole and to hold down said power wires of said 4-pole female connector in place;

a rear cap fastened to the rear sidewall of said housing by screws, said rear cap having a center through hole for the passing of said conducting wires;

a flexible bellows tube mounted around said conducting wires and connected to said rear cap; and a plurality of projecting members projecting from the rear sidewall, said projecting members each having a partition plate of V-shaped cross section adapted to prohibit accidental contact between said metal contact plates.

2. The towing connector as claimed in claim 1, wherein said housing has a plurality of end notches disposed in the rear sidewall and respectively connected to respective rear ends of said mounting slots for the positioning of the rear connecting portions of said metal contact plates.

3. The towing connector as claimed in claim 1, wherein the number of the mounting slots of said housing is 6, and the number of said metal contact plates fits the number of the mounting slots of said housing.

* * * * *